US005395043A

United States Patent [19]

Bacques et al.

[11] Patent Number: 5,395,043

[45] Date of Patent: Mar. 7, 1995

[54] A BLANK FOR MAKING A BOX AROUND A LOAD

[75] Inventors: Jean-Yves Bacques, Paris; Guy Coalier, Noce, both of France

[73] Assignee: OTOR, Paris, France

[21] Appl. No.: 172,267

[22] Filed: Dec. 23, 1993

Related U.S. Application Data

[63] Continuation of Ser. No. 10,174, Jan. 28, 1993, Pat. No. 5,295,623.

[30] Foreign Application Priority Data

Feb. 20, 1992 [FR] France ..... 92 01915

[51] Int. Cl.[6] ..... B65D 5/06; B65D 85/62

[52] U.S. Cl. ..... 229/109; 206/427; 229/117.16

[58] Field of Search ..... 229/40, 109, 117.16, 229/117.17, 182.1; 206/427; 53/443, 448, 456

[56] References Cited

U.S. PATENT DOCUMENTS

| | | | |
|---|---|---|---|
| 2,347,422 | 4/1944 | Loth | 229/109 |
| 2,372,312 | 3/1945 | Buttery | 229/109 |
| 2,645,405 | 7/1953 | Dorfman | 229/117.16 |
| 2,705,556 | 4/1955 | Ringler | 229/427 |
| 2,751,075 | 6/1956 | Arneson | 229/40 |
| 2,899,123 | 8/1959 | Currie, Jr. | 229/40 |
| 3,512,697 | 5/1970 | Robinson | 229/109 |
| 3,807,624 | 4/1974 | Funkhouser | 228/40 |
| 3,923,234 | 12/1975 | Lund, Jr. | 229/109 |
| 3,979,882 | 9/1976 | Howe | 53/24 |
| 4,067,442 | 1/1978 | Howe | 206/433 |
| 4,308,020 | 12/1981 | Langen | 493/175 |
| 4,793,546 | 12/1988 | Nunn | 229/109 |

FOREIGN PATENT DOCUMENTS

| | | | |
|---|---|---|---|
| 1462391 | 12/1966 | France | 229/40 |
| 2196630 | 3/1974 | France . | |
| 2508415 | 12/1982 | France | 206/427 |
| 3515354 | 10/1986 | Germany . | |
| 2201396 | 9/1988 | United Kingdom . | |

*Primary Examiner*—Gary E. Elkins
*Attorney, Agent, or Firm*—Fisher, Christen & Sabol

[57] ABSTRACT

The present invention relates to a method, a blank, and a box enabling packaging to be obtained that is fitted to the load to be packaged. According to the invention, a blank made of cut-out panels is wrapped around and is pressed against the load while the load is standing on one of the panels of the blank.

13 Claims, 4 Drawing Sheets

A BLANK FOR MAKING A BOX AROUND A LOAD

This is a continuation of Ser. No. 08/010,174, filed on Jan. 28, 1993, now U.S. Pat. No. 5,295,623, issued on Mar. 22, 1994.

The present invention relates to a method of making a polygonal section box from a blank of sheet material or the like, e.g. card, corrugated cardboard, etc.

BACKGROUND OF THE INVENTION

Methods are already known for obtaining a polygonal section box on a single manufacturing line by means of successive folding operations on a card blank, which operations are more particularly referred to as "wrap-around" operations.

For example, Document US-A-4 308 020 teaches one such technical method that enables a box to be made from a card blank by means of a suitable machine fitted with a mandrel, the box also containing the object to be packaged, such as a bottle in this case, and the blank being wound around said mandrel. To this end, the blank includes a sequence of four panels connected to one another via parallel fold lines, and provided with lateral flaps that are connected to respective ones of said panels via fold lines perpendicular to the fold lines of said panels. In that document, the mandrel is hollow so as to receive the bottle to be packaged, and it is square in section. The four panels are then rectangular and identical and they are wound around the mandrel by folding so as to form the four faces of the lateral belt of the box, after which the lateral flaps situated at one end of the panels are folded to form the bottom of the box, and then, after the mandrel has been removed from the lateral belt of the box while leaving the bottle therein, the lateral flaps situated at the other end of said panels, are in turn folded to constitute the cover of the box containing said bottle.

Although that wrap-around type method gives results that are satisfactory since it makes it possible at the end of the manufacturing line, to obtain a box or packaging containing the object concerned and made from a blank, it nevertheless suffers from a certain number of drawbacks.

Firstly, in order to make the box, it is necessary to have a plurality of distinct workstations along the manufacturing line in order to form the lateral belt thereof, its bottom, and its cover on the basis of the panels and flaps of said blank.

Further, it appears difficult to package a group of objects, particularly if they are cylindrical. The danger is that they will not be held sufficiently tangentially in the desired position firstly against one another and secondly against the faces of the box constituted by said panels, e.g. when the mandrel is being removed, and as a result they may strike one another or be damaged during subsequent operations and handling of the boxes.

Furthermore, disposing an object, often such as a circular section bottle, in a box that is square in section does not cause the bottle to be effectively immobilized since it is in tangential contact only with no more than four lateral faces of the box. The four corners of the box constituted by two adjacent lateral faces of the box and defining 90° angles are empty, such that the bottle can move inside the box.

Also, the four corners of a square section box run the risk of being damaged since they project, and they do not impart any increased compression strength to the box. Furthermore, the four projecting corners of the box represent a significant loss of card blank material. In addition, from the point of view solely of appearance, making a box that is purely in the form of a right parallelepiped is very ordinary and not very attractive, commercially.

OBJECTS AND SUMMARY OF THE INVENTION

An object of the present invention is to remedy the above drawbacks.

To this end, the present invention provides a method of making a polygonal section box from a blank of sheet material or the like, and including a sequence of at least four panels connected to one another via parallel fold lines and provided with lateral flaps connected to respective ones of said panels via fold lines perpendicular to the fold lines between said panels, the method being remarkable in that:

- two of said panels constituting a spaced-apart pair, are intended to form the bottom and the cover of said box;
- cut-off corners are formed having at least one edge on the two spaced-apart panels suitable for forming the bottom and the cover of said box;
- intermediate panels are provided between the other two spaced-apart panels and their respective lateral flaps, having fold lines with said panels that are parallel to the fold lines with said flaps;
- an object or a group of objects to be packaged is placed on said panel having cut-off corners that forms the bottom of said box, which panel is situated between the two other panels that are provided with intermediate panels;
- said panels adjacent to said bottom-forming panel are folded about their fold lines so as to extend perpendicularly to the bottom-forming panel;
- the said intermediate panels and the said lateral panels extending them, now extending perpendicularly to the bottom-forming panel, are folded about their fold lines respectively along the cut-off corners and said fold lines connecting said bottom-forming panel to its lateral flaps so as to co-operate with said panels from which they project to form the lateral belt of said box;
- said panel having cut-off corners extending the corresponding panel adjacent to the bottom forming panel is folded about its fold line so as to extend parallel to the bottom forming panel, thus forming the cover of said box; and
- the lateral flaps of the two panels having cut-off corners are folded about their fold lines at least against the lateral flaps forming the lateral belt of said box to be obtained, and they are fixed thereto.

Thus, because of the invention, one of the panels of the blank is used as a support for the object or the group of objects to be packaged, which support acts as the bottom of the resulting box. Consequently, it can be made in a fixed workstation without needing to be displaced, with the various panels, intermediate panels, and lateral flaps of the blank being folded during the steps of the method.

In addition, since the panels forming the bottom and the cover have their corners cut off, and since intermediate panels are provided between the other two panels of the sequence of panels together with their lateral flaps, a box is obtained after folding that is at least octagonal in section, being quadrangular with cut-off corners. The box made in this way has eight parallel edges, giving it increased compression strength. In addition, its eight lateral faces forming the belt, four of which correspond to said intermediate panels folded along said cut-off corners, considerably increase the immobilization of the object or the group of objects, since if the object is a circular section bottle, for example, it gives rise to eight object-supporting generator lines distributed around the lateral surface thereof.

It is also observed that with cut-off corners, and thus with a larger number of lateral faces, a box is obtained that is a closer fit around the outline of the object or group of objects to be packaged, which has the consequence of achieving an appreciable saving of material, when designing and manufacturing blanks.

Furthermore, the box obtained from the blank and by implementing the method has a particular and original appearance which makes it attractive.

The invention also provides a blank for making a polygonal section box, the blank being of the type made of sheet material or the like and including a sequence of at least four panels connected to one another by fold lines and provided with lateral flaps that are connected to respective ones of said panels by fold lines perpendicular to the fold lines between said panels.

Advantageously, two of said panels that constitute a spaced-apart pair have cut-off corners having at least one edge each, and respectively define the bottom and the cover of said box to be obtained, intermediate panels being provided between the other two panels that constitute a spaced-apart pair and the lateral flaps thereof, which intermediate panels have fold lines with said panels that are parallel to their fold lines with said flaps.

Preferably, the corners of said panels concerned, suitable for defining the bottom and the cover of the box to be obtained, are cut off at 45° relative to the fold lines of said panels.

More particularly, the width of said intermediate panels between their fold lines corresponds substantially to the length of said cut-off corners, and the width of said lateral flaps extending said intermediate panels is substantially equal to one-half of the length of said fold lines connecting each panel having cut-off corners to its lateral flaps.

Thus, after being folded, the two lateral flaps situated on the same side of said intermediate panels are such that their respective edges are substantially in contact with each other, so as to form one of the faces of the lateral belt of said box.

According to another feature of said blank, said lateral flaps extending from said panels having cut-off corners are advantageously provided with lateral tongues situated respectively on either side of each of them and hinged about fold lines perpendicular to those connecting said lateral flaps to said panels having cut-off corners, said tongues being suitable for being fixed against said intermediate panels after said blank has been folded. Thus, when they press against the intermediate panels, the four lateral tongues produce a wedging effect tending to press said intermediate panels against the group of objects, and thus tending to urge said objects tightly against one another. Consequently, said objects are better held immobile in the box, by means firstly of the eight faces of the octagon of the box pressing tangentially against said objects, and secondly by means of said tongues additionally pressing said faces against the objects.

In addition, a tongue is hinged to said panel having cut-off corners that is suitable for defining the cover of the box about a fold line parallel to the fold lines connecting said panels together. The tongue is suitable for being fixed to the free edge of the panel concerned in order to close the box.

Preferably, adhesive zones are provided on said lateral tongues extending said lateral flaps associated with the intermediate panels, and also on said tongue extending said corresponding panel having cut-off corners.

Furthermore, notches are formed in said lateral flaps associated with said intermediate panels, opening out in their respective free edges, such that the notches of two lateral flaps situated on the same side of the blank define an oblong opening after the blank has been folded.

Two oblong openings are thus made for use when holding the box.

Under such circumstances, pre-cutout hinged tongues are then formed in the free edges of the two lateral flaps that extend said cover-forming panel having cut-off corners so that after being folded they engage in said oblong openings, being folded into the box between the lateral flaps forming the lateral belt of said box.

The invention also provides a box of sheet material such as card or corrugated cardboard, having a section parallel to its bottom that is at least octagonal and that is delimited by lateral faces forming the belt of the box.

The, box is remarkable in that two opposite lateral faces thereof are each constituted by two lateral flaps extending in line with each other and having free edges that are close together, and in that lateral flaps extending respectively from opposite ends of said bottom and of said cover are fixed against said lateral flaps forming said two opposite lateral faces.

BRIEF DESCRIPTION OF THE DRAWINGS

The figures of the accompanying drawings show clearly how the invention can be implemented. In the figures, identical references designate items that are similar.

MORE DETAILED DESCRIPTION

Figure 1:
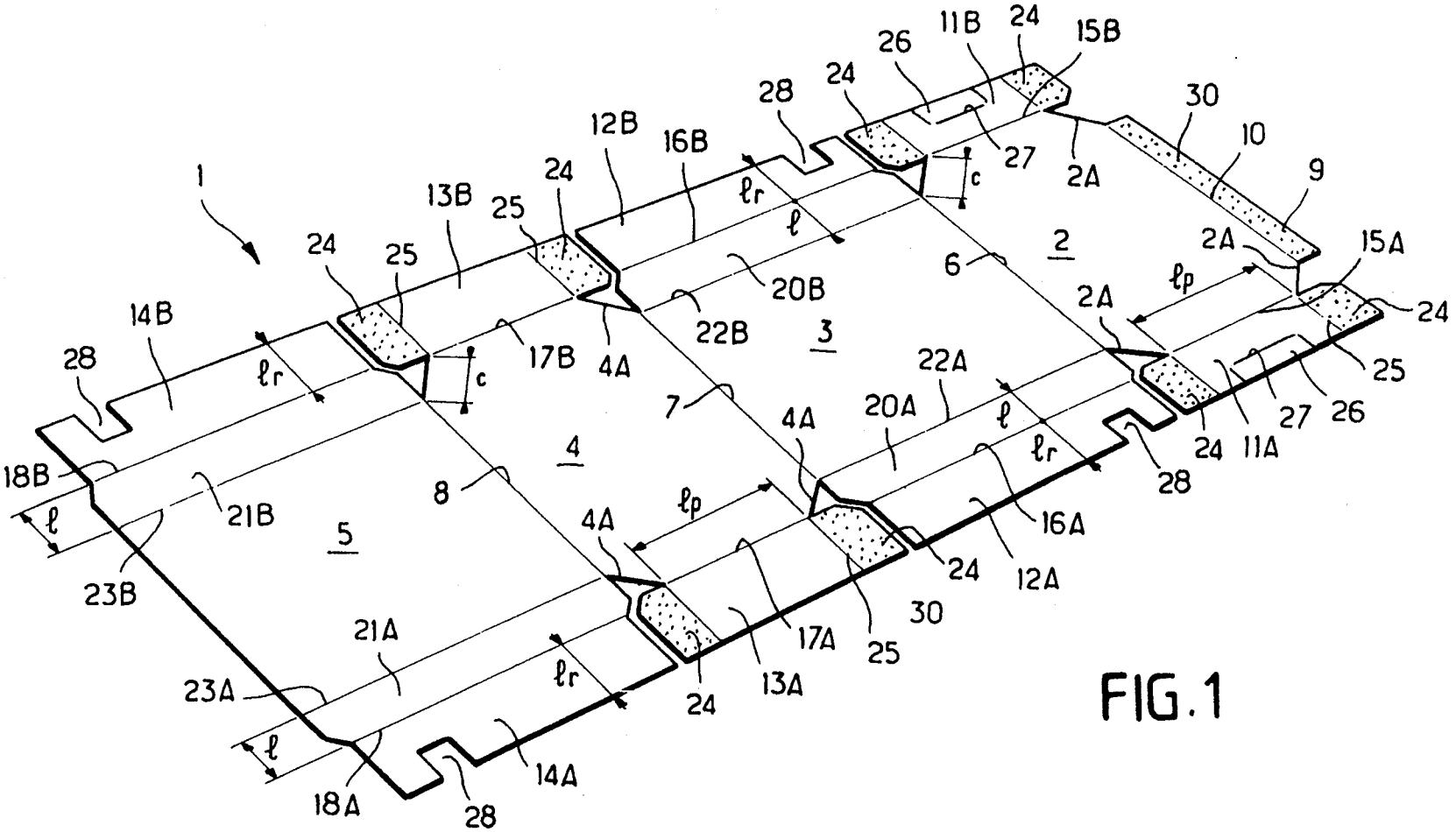
FIGS. 1 to 6 are perspective views of various steps in the method of the invention for making an octagonal section box containing the objects to be packaged using a blank made from sheet material.

The method of the invention is implemented, for example, starting from the blank 1 shown in FIG. 1 which is made of sheet material such as card or corrugated cardboard.

In this preferred implementation, the blank 1 comprises a sequence of four polygonal panels 2, 3, 4, and 5 that are identical in pairs, and that are connected to one another along preformed parallel fold lines 6, 7, and 8. More particularly, panels 2 and 4 are rectangular, but have identical cut-off corners 2A and 4A having one edge each, such that each of said panels defines an octagonal shape which, advantageously, and in accordance with the invention, is designed to correspond to the octagonal section of the box to be obtained. The four corners 2A and 4A of the panels are cut off at 45°. As for the other two panels 3 and 5 which are also identical to each other, they are rectangular. Thus, the sequence of panels in the blank 1 comprises an end panel 2 having cut-off corners and connected via fold line 6 to rectangular panel 3, which is in turn connected to the other panel 4 having cut-off corners via fold lines 7, and the panel 4 is connected via fold line 8 to the other rectangular panel 5 which terminates the other end of the sequence. In addition, the panel 2 having cut-off corners 2A extends away from the panel 3 in the form of a tongue 9 which is hinged to the panel 2 about a fold line 10 parallel to the preceding fold lines 6, 7, and 8.

In addition, lateral flaps 11A & 11B, 12A & 12B, 13A & 13B, and 14A & 14B are provided at respective sides of the panels 2, 3, 4, and 5 of the blank 1. Thus, the lateral flaps 11A, 11B and 13A, 13B are identical and are connected to their corresponding panels 2 and 4 about respective fold lines 15A, 15B and 17A, 17B perpendicular to the fold lines 6, 7, 8, and 10. Similarly, the lateral flaps 12A, 12B and 14A, 14B are identical and are connected to their corresponding panels 3 and 5 about respective fold lines 16A, 16B and 18A, 18B perpendicular to the fold lines 6, 7, 8, and 10. Also, the free edges of the flaps situated on the same side of the blank 1 are in alignment.

It may also be observed that intermediate panels 20A, 20B and 21A, 21B are provided between the rectangular panels 3 and 5 and their respective lateral flaps 12A, 12B and 14A, 14B. Each intermediate panel is thus hinged about two parallel fold lines, one corresponding to that of the corresponding lateral flap and the other corresponding to that of the rectangular panel. Thus, the intermediate panels 20A and 20B are connected to the rectangular panel 3 via fold lines 22A and 22B, while the intermediate panels 21A and 21B are connected to the rectangular panel 5 via fold lines 23A and 23B.

As shown in FIG. 1, these fold lines 22A, 22B, 23A, and 23B are situated in line with the edges formed between the parallel fold lines 6, 7, and 8 and the corresponding cut-off corners 2A and 4A. In addition, the width $\underline{l}$ of each intermediate panel 20A, 20B, 21A, and 21B lying between the parallel fold lines connecting it to the corresponding rectangular panel and lateral flap is equal to the length $\underline{c}$ of the cut-off corners 2A and 4A of the octagonal panels 2 and 4.

Furthermore, the width $\underline{lr}$ of the identical lateral flaps 12A, 12B, 14A, and 14B is substantially equal to one-half of the length $\underline{lp}$ of the fold lines 15A, 15B, 17A, and 17B.

The blank 1 also has identical lateral tongues 24 extending respectively from opposite ends of the lateral flaps 11A, 11B and 13A, 13B of the panels 2 and 4 having cut-off corners. These lateral tongues 24 are hinged to the corresponding lateral flaps about fold lines 25 perpendicular to the fold lines 15A, 15B, 17A, and 17B connecting the flaps to said octagonal panels 2 and 4. It may also be observed in FIG. 1 that foldable tongues 26 are pre-cutout in the lateral flaps 11A and 11B, each opening out to the free edge of its lateral flap and being capable of pivoting about a fold line 27 parallel to the fold line 15A or 15B of the lateral flap 11A or 11B.

Furthermore, a notch 28 is formed in the free edge of each of the lateral flaps 12A, 12B and 14A, 14B connected to the respective intermediate panels. These notches 28 are U-shaped. Thus, when the two lateral flaps situated on the same side of the blank 1 are moved into line with each other, as explained below, these notches form an oblong opening for use in holding the box.

Finally, adhesive zones 30 represented by stippling in the figures are provided, for example, on the tongue 9 and on the lateral tabs 24.

The method of the invention for making a polygonal section box is as follows.

Firstly, it is recalled that 45° cut-off corners respectively referenced 2A and 4A are formed in the spaced-apart pair of panels 2 and 4 of the blank and that intermediate panels 20A, 20B, 21A, and 21B are formed between the other two spaced-apart panels 3 and 5 of the blank that are rectangular and their corresponding lateral flaps.

The method consists in taking advantage of the octagonally shaped cut-off corner panels 2 and 4 to define the bottom and the cover of the box to be obtained, which box is then octagonal in section, corresponding to the outline of the two identical panels 2 and 4.

Figure 2:
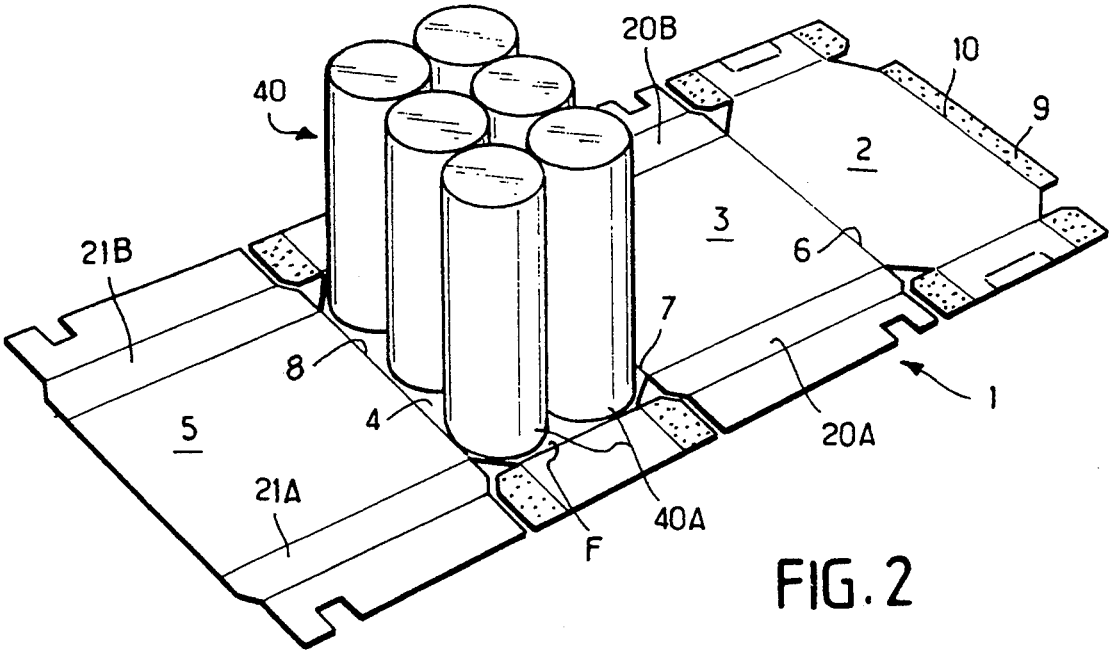

As shown in FIG. 2, a group of identical objects 40, e.g. six objects of circular section, is placed on octagonal panel 4 that forms the bottom F of the box. These objects may be receptacles such as cans for sparkling beverages or fruit beverages. The bases 40A of these receptacles standing on the panel 4 all lie within the perimeter thereof.

Figure 3:
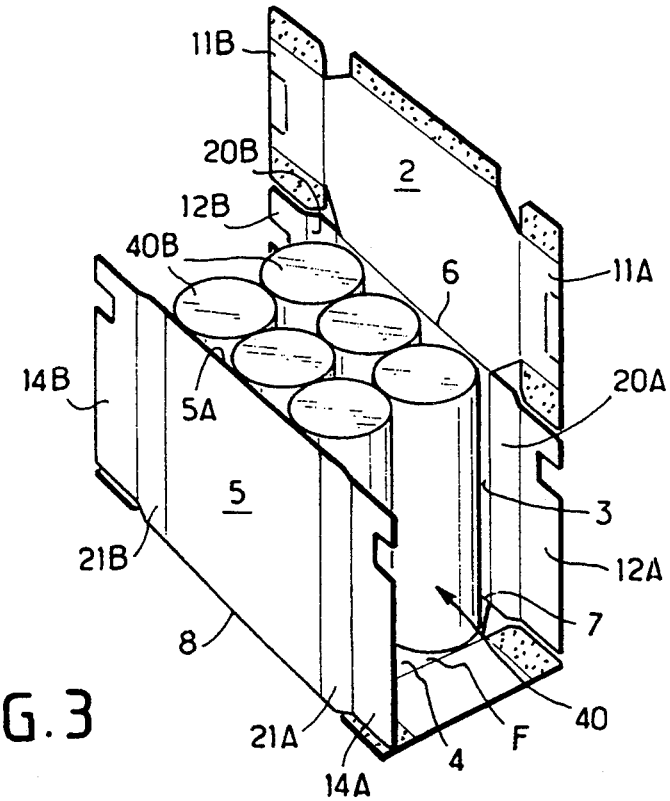

The rectangular panels 3 and 5 are then folded about the fold lines 7 and 8 so as to become perpendicular to the octagonal panel 4 forming the bottom. These panels 3 and 5 may be folded by any suitable known means (not shown) such as moving pressure plates, so as to move said panels 3 and 5 vertically upwards. FIG. 3 shows that the height of the panels 3 and 5 is not less than the height of the receptacles 40 such that the free edge 5A of the end rectangular panel 5 and the fold line 6 connecting the rectangular panel 3 to the octagonal panel 2 that extends it are at least flush with the tops 40B of said receptacles. Furthermore, the lateral flaps 12A, 12B, 14A, and 14B and the intermediate panels 20A, 20B, 21A, and 21B extend respective opposite ends of the vertically upstanding rectangular panels.

Figure 4:
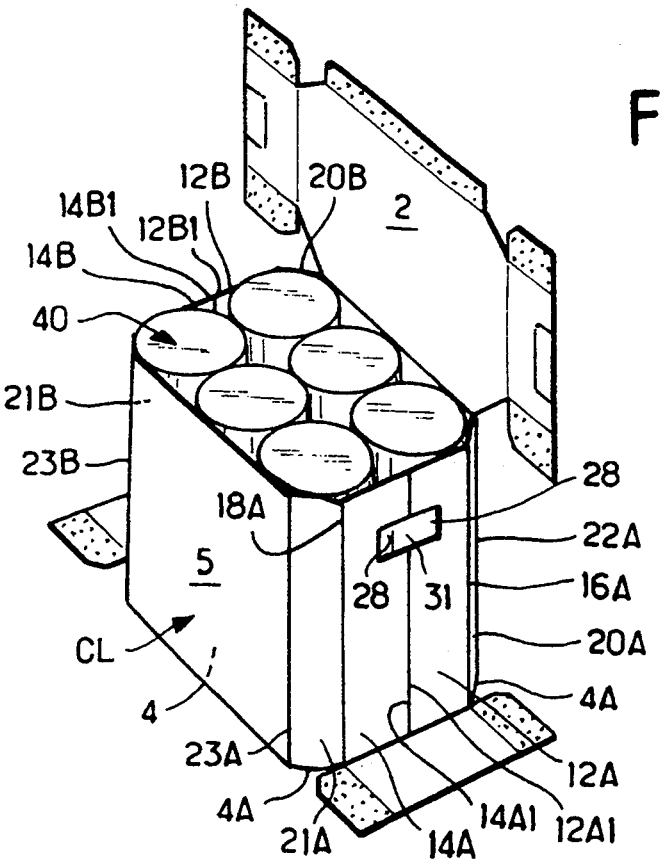

The following step of the method consists in folding over said intermediate panels 20A, 20B, 21A, and 21B, and the lateral flaps 12A, 12B, 14A, and 14B that extend them, as shown in FIG. 4. To do this, each assembly constituted by an intermediate panel and the lateral flap extending it is folded by appropriate thrust means (not shown) firstly so as to bring the intermediate panels 20A, 20B, 21A, and 21B respectively over the cut-off corners 4A of the panel 4 by pivoting about their folds lines 22A, 22B, 23A, and 23B, and secondly the lateral flaps 12A, 12B, 14A, and 14B along said fold lines 17A and 17B connecting the octagonal panel 4 to its flaps 13A and 13B by pivoting around the fold lines 16A, 16B and 18A, 18B.

Since the width $\underline{lr}$ of the identical lateral flaps is equal to half the length $\underline{lp}$ of the fold lines 17A and 17B, the two lateral flaps 12A, 14A and 12B, 14B situated on the same side of the blank are then in line with each other once folded over, such that their respective free edges 12A1, 14A1 and 12B1, 14B1 face each other. Simultaneously, the notches 28 in these pairs of flaps are brought into line with each other as to form two opposite oblong openings 31.

It can thus be seen that the rectangular panels 3 and 5, the intermediate panels 20A, 20B, 21A, and 21B, and the lateral flaps 12A, 12B, 14A, and 14B automatically form the lateral belt CL of the future box while the receptacles are already in place on the panel 4 that forms the bottom.

Figure 5:
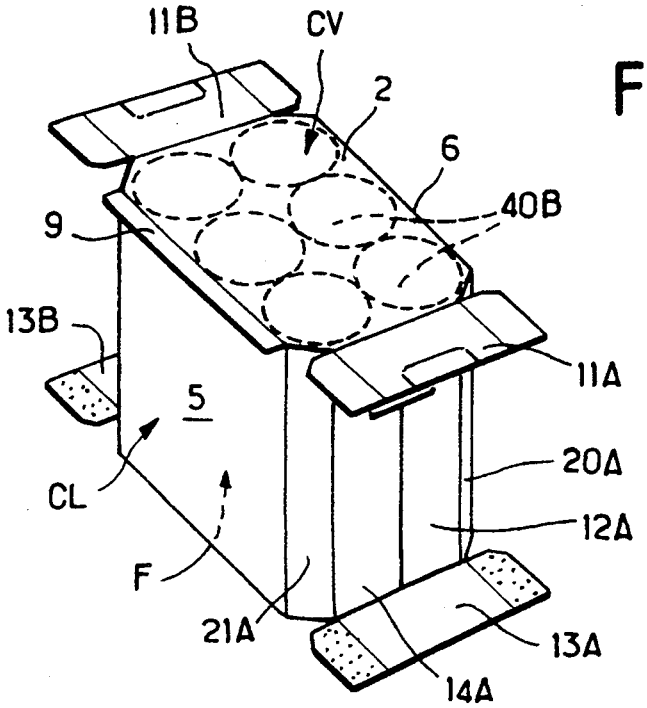

At this stage, the octagonal panel 2 is folded about its fold line 6 so as to come substantially into contact with the tops 40B of the receptacles 40 and form the cover CV that closes the box, as shown in FIG. 5.

Figure 6:
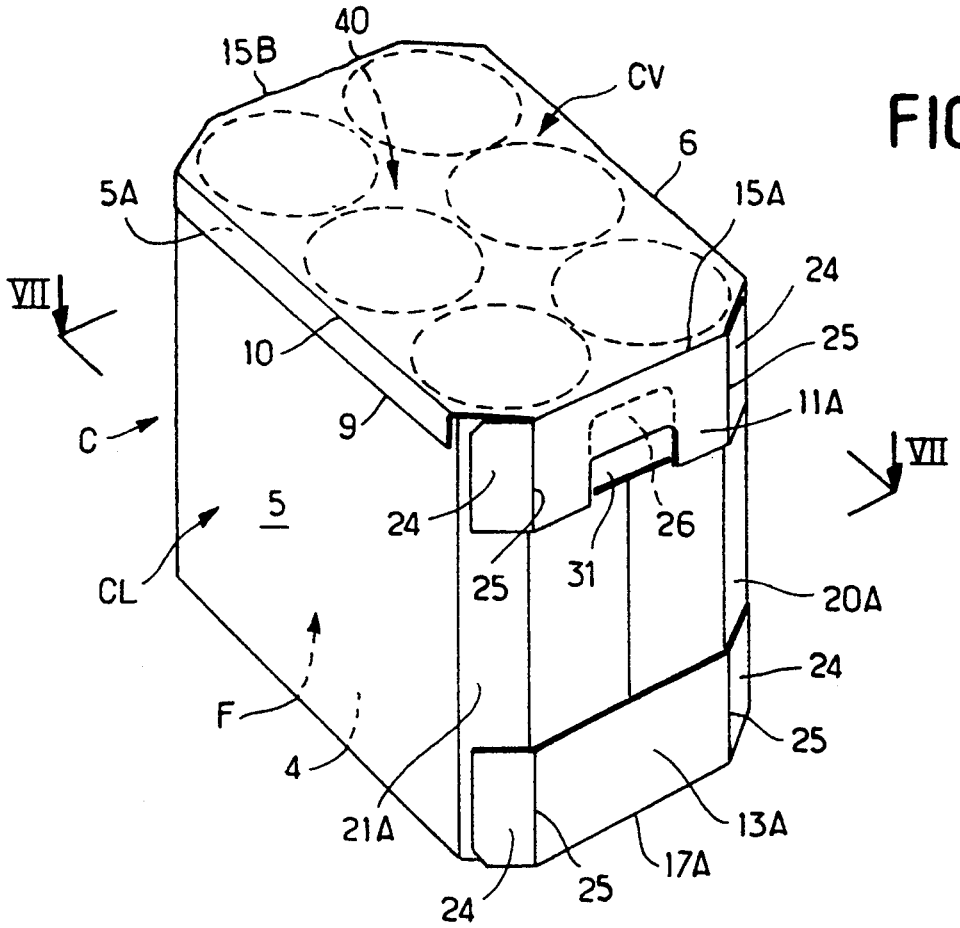

Thereafter, the lateral flaps 13A, 13B and 11A, 11B projecting from the octagonal panels 4 and 2 respectively are folded about the fold lines 17A, 17B and 15A, 15B so as to come against the corresponding lateral flaps 12A, 12B, 14A, and 14B which extend vertically and form the lateral belt of the box. More particularly, as shown in FIG. 6, the lateral flaps 13A, 13B are folded upwards to overlie the bottom portions of the flaps 12A, 14A and 12B, 14B, while the lateral flaps 11A, 11B are folded downwards to overlie the top portions of the flaps 12A, 14A and 12B, 14B.

Figure 7:
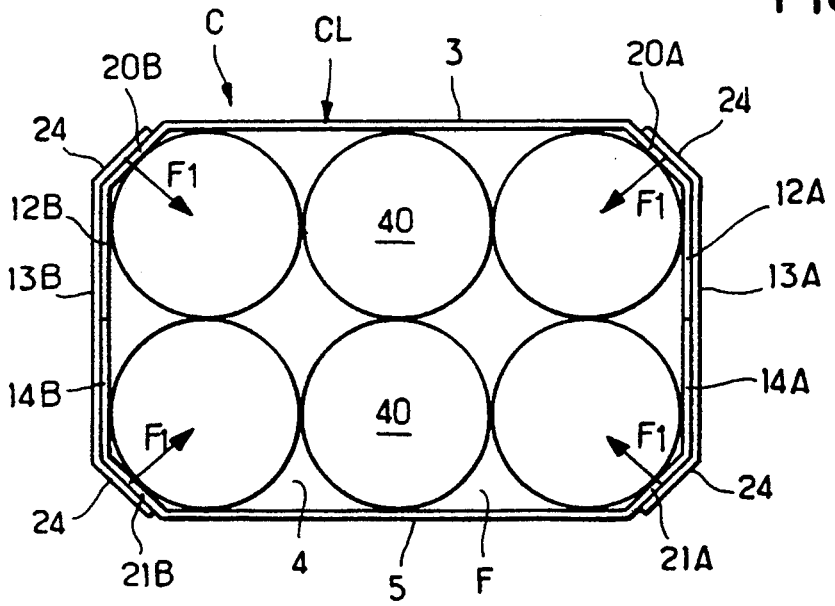
FIG. 7 is a section through said box on line VII—VII of FIG. 6.

Using suitable thrust plates (not shown), the two tongues 24 extending respectively from opposite ends of the flaps 13A, 13B, 11A, and 11B are also folded about fold lines 25 to come against the top and bottom portions of the intermediate panels 20A, 20B, 21A, and 21B. This has the consequence firstly of producing a wedging effect as shown by arrows F1 in FIG. 7 urging the receptacles towards one another and fitting the box C around the group of objects 40 by the action of the panels 3, 5, 20A, 20B, 21A, and 21B and of the lateral flaps 12A, 12B, 14A, and 14B pressing tangentially against said receptacles 40, and forming the lateral belt CL of the box C. Secondly it has the consequence of providing final fixing for the panels 2 and 4 which form the bottom F and the cover CV of the box C, said panels being secured to the panels 3, 5, 20A, 20B, 21A, 21B, and to the flaps 12A, 12B, 14A, and 14B by means of lines of adhesive 30 provided on the tongues 24 and also on the tongue 9 which is subsequently also folded about fold line 10 against the top edge 5A of rectangular panel 5.

The tongues 26 provided at the edges and in the middles of the lateral flaps 11A and 11B are then folded around the fold lines 27 through the notches 28 by pressing inwardly against the flaps so as to reveal the two openings 31 defined by said notches. This facilitates handling of the box C made in this way while it contains the receptacles.

In the preferred embodiment described above, the corners of said panels 2 and 4 are cut off at 45° along continuous straight lines so that after the blank has been folded it constitutes a box that is octagonal in section. Naturally, the corners could be cut off firstly at different angles (identical or otherwise) and secondly they could be cut along discontinuous lines so as to follow a path having several edges such that after the blank has been folded, the resulting box is of polygonal section having more than eight sides. For example, each corner could be cut off along a bent line having two identical edges, so as to form a box whose section has twelve sides, with each intermediate panel then being constituted by two identical hinged-together panel portions. As a result, not only is the compression strength of the box improved, but the group of objects is also held tangentially by twelve lateral faces that contribute to immobilizing the objects.

We claim:

1. A blank for making a polygonal section box made of sheet material, comprising a sequence of at least four panels connected to one another via fold lines and having lateral flaps connected respectively to said panels via fold lines perpendicular to the fold lines interconnecting said panels, at least two of said panels which constitute a spaced-apart pair have cut-off corners, each of said cut-off corners having at least one edge, and which respectively are the bottom and the top of said box, and intermediate panels are provided between the other at least two panels that constitute a spaced-apart pair and the lateral flaps thereof, which intermediate panels have fold lines with said panels which are parallel to the fold lines of said at least two panels having said flaps, notches being formed in said lateral flaps associated with said intermediate panels, opening out in respective free edges thereof, such that the notches of lateral flaps situated on a side of the blank define an oblong opening after the blank has been folded, and pre-cutout, hinged tongues being formed in the free edges of the lateral flaps of said cover-forming panel having cut-off corners so that after being folded said pre-cutout, hinged tongues engage in said oblong openings, being folded so as to be inserted between the lateral flaps forming a lateral belt for said box.

2. The blank according to claim 1 wherein the corners of concerned said panels, for defining the bottom and the cover of the box, are cut off at 45° relative to the fold lines of said panels.

3. The blank according to claim 1 wherein the width of said intermediate panels between the fold lines thereof corresponds substantially to the length of said cut-off corners, and wherein the width of said lateral flaps of said intermediate panels is substantially equal to one-half of the length of said fold lines connecting each of said panel having cut-off corners to said lateral flaps thereof.

4. The blank according to claim 1 wherein said lateral flaps extending from said panels having cut-off corners are provided with lateral tongues situated respectively on either side of each of them and hinged about fold lines perpendicular to those connecting said lateral flaps to said panels having cut-off corners, said tongues being suitable for being fixed against said intermediate panels after said blank has been folded.

5. The blank according to claim 1 wherein a tongue is hinged to said panel having cut-off corners that defines the corner of the box about a fold line parallel to the fold lines connecting said panels together.

6. The blank according to claim 1 wherein a tongue is hinged to said panel having cut-off corners that defines the cover of the box about a fold line parallel to the fold lines connecting said panels together, and wherein adhesive zones are provided on said lateral tongues of said lateral flaps associated with the intermediate panels, and also on a tongue which extends said corresponding panel having cut-off corners.

7. A blank for making a polygonal section box made of sheet material, consisting of a set of four rectangular of substantially rectangular panels and a tongue, connected to one another via first fold lines and having lateral flaps connected respectively to said panel via second fold lines perpendicular to the first fold lines interconnecting said panels, two of said panel being identical with their flaps and constituting a spaced-apart pair having cut-off corners, said cut-off corners having free edges deprived of any flap, said spaced apart pair being arranged to be the bottom and the top of said box, and sole intermediate panels are provided between the other panels being identical with their flaps and intermediate panels and constituting the other spaced-apart pair and the lateral flaps thereof, which intermediate panels have folds lines with said panels which are parallel to the second folds lines of said two panels having said flaps, and wherein the width of the identical lateral flaps is equal to half the length of the second fold lines of the panel with cut-off corners.

8. The blank according to claim 7 wherein the corners of concerned said panels, for defining the bottom and the cover of the box, are cut off at 45° relative to the fold lines of said panels.

9. The blank according to claim 7 wherein said lateral flaps extending from said panels having cut-off corners are provided with lateral tongues situated respectively on either side of each of them and hinged about fold lines perpendicular to those connecting said lateral flaps to said panels having cut-off corners, said tongues being suitable for being fixed against said intermediate panels after said blank has been folded.

10. The blank according to claim 7 wherein a tongue is hinged to said panel having cut-off corners that defines the cover of the box about a fold line parallel to the fold lines connecting said panels together.

11. The blank according to claim 7 wherein a tongue is hinged to said panel having cut-off corners that defines the cover of the box about a fold line parallel to the fold lines connecting said panels together, and wherein adhesive zones are provided on said lateral tongues of said lateral flaps associated with the intermediate panels, and also on a tongue which extends said corresponding panel having cut-off corners.

12. The blank according to claim 7 wherein notches are formed in said lateral flaps associated with said intermediate panels, opening out in respective free edges thereof, such that the notches of lateral flaps situated on a side of the blank define an oblong opening after the blank has been folded.

13. The blank according to claim 12 wherein pre-cut-out, hinged tongues are formed in the free edges of the lateral flaps of said cover-forming panel having cut-off corners so that after being folded said pre-cutout, hinged tongues engage in said oblong openings, being folded so as to be inserted between the lateral flaps forming a lateral belt for said box.

* * * * *